United States Patent [19]

Nitta

[11] Patent Number: 4,863,373

[45] Date of Patent: Sep. 5, 1989

[54] TABLETOP GASLIGHTER

[75] Inventor: Tomio Nitta, Yokohama, Japan

[73] Assignee: Tokai Corporation, Yokohama, Japan

[21] Appl. No.: 200,862

[22] Filed: Jun. 1, 1988

[30] Foreign Application Priority Data

Jun. 11, 1987 [JP] Japan ..... 62-89008[U]

[51] Int. Cl.[4] ..... F23Q 3/01

[52] U.S. Cl. ..... 431/255

[58] Field of Search ..... 431/129, 142, 143, 254, 431/255, 130–132

[56] References Cited

U.S. PATENT DOCUMENTS

| | | | |
|---|---|---|---|
| 3,764,256 | 10/1973 | Moriya | 431/255 |
| 3,771,943 | 11/1973 | Schlamp | 431/255 |
| 3,883,289 | 5/1975 | Fujioka | 431/255 X |
| 3,970,420 | 7/1976 | Goto | 431/255 |
| 4,179,260 | 12/1979 | Lowenthal | 431/255 |

*Primary Examiner*—Margaret A. Focarino
*Attorney, Agent, or Firm*—Armstrong, Nikaido, Marmelstein, Kubovcik & Murray

[57] ABSTRACT

Tabletop gaslighter the parts are designed to facilitate the full automatic assembly of these parts into tabletop gaslighters. Parts can be put on each other in a predetermined order, and can be fixedly combined without using screws. The gas lighter comprises a casing, a gas cell having a flame valve fixed to one side of the gas cell and a longitudinal hole made at the other side of the gas cell, a hollow bracket to be clicked to the top of the gas cell with associated catch, supporting a flame adjusting ring and a valve operating lever, a piezoelectric unit to be inserted in the longitudinal hole of the gas cell, and a top closure to be fixed to the casing with associated catch to prevent the bracket, gas cell and other parts from slipping off from the casing.

1 Claim, 4 Drawing Sheets

TABLETOP GASLIGHTER

BACKGROUND OF THE INVENTION

1. Field of the Invention

The present invention relates to a gaslighter which is designed to be put and used on a table.

2. Related Art

A conventional tabletop gaslighter is composed of a gas cell and a piezoelectric device as a fire striking unit. These are put in a casing, which presents a nice appearance. Ordinarily a support is used for holding the gas cell, fire striking unit and other necessary parts. Then, the casing is put on the support, and the support is fixed to the inside of the casing by screws.

This arrangement requires many assembling steps with hands; many parts must be oriented and fixed to the support one after another, and then the casing must be fixed to the support with screws. This prevents automatization in assembling necessary parts to tabletop gaslighters.

SUMMARY OF THE INVENTION

With this in mind, the object of the present invention is to provide a tabletop gaslighter whose construction is adaptable to full automatization in assembling necessary parts to tabletop gaslighters, thereby reducing the production cost to possible minimum.

To attain this object, a tabletop gaslighter according to the present invention comprises a casing which is closed at its bottom and open a its top; a gas cell to be fitted in the casing, the gas cell having a flame valve built in on one side of the gas cell and a longitudinal hole made on the other side of the gas cell; a hollow bracket to be clicked to the top of the gas cell with an associated catch, allowing the flame valve to pass through the bracket and supporting a flame adjusting ring and a valve operating lever; a piezoelectric unit to be inserted in the longitudinal hole of the gas cell, the piezoelectric unit having a thumb-operated cap put on its top; and a top closure to be clicked to the casing with associated catch to prevent the thumb-operated cap, bracket and gas cell from slipping off, whereby the depressing of the thumb-operated cap causes the simultaneous operation of the piezoelectric unit and valve operating lever to strike spark across the ejection of gas and cause a small flame to shoot upward.

In assembling the gas cell is pushed in the casing, and then the bracket is clicked to the top of the gas cell. The piezoelectric unit is pushed into the gas cell. Then, the top closure is clicked to the casing to hold these parts in position. Thus, necessary parts are packed in the casing one after another in such a way that they are piled up on each other.

Other objects and advantages of the present invention will be best understood from the following description of a tabletop gaslighter according to a preferred embodiment of the present invention, which embodiment is shown in the accompanying drawings:

PREFERRED EMBODIMENT

Figure 1:
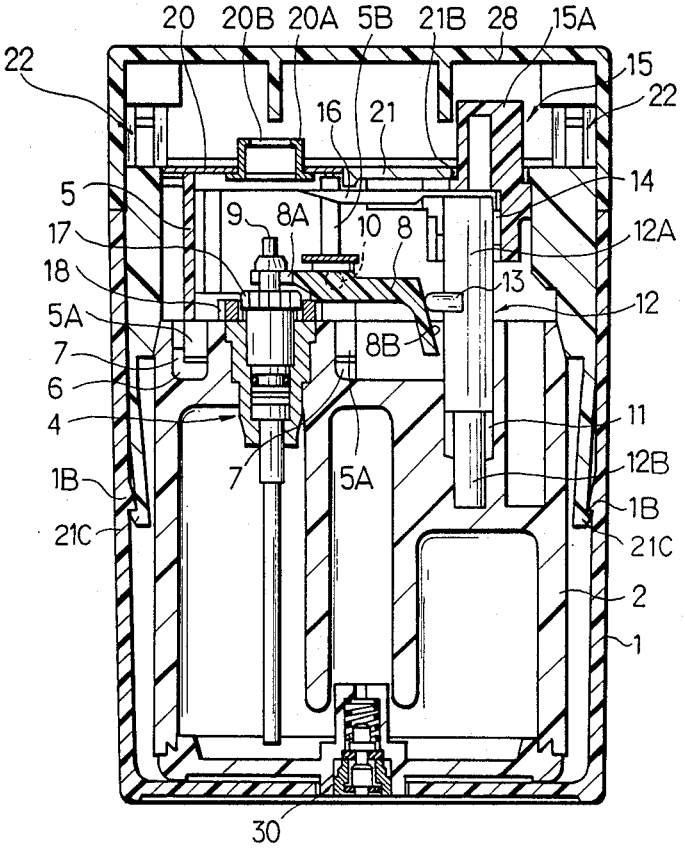
FIG. 1 is a longitudinal section of a tabletop gaslighter according to preferred embodiment of the present invention.
Figure 2:
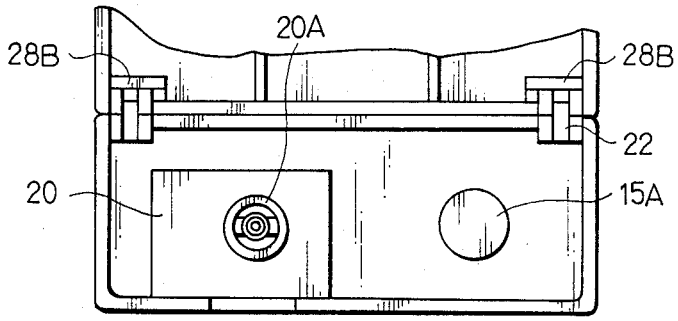
FIG. 2 is a plane view of the tabletop gaslighter with its closure removed.
Figure 3:
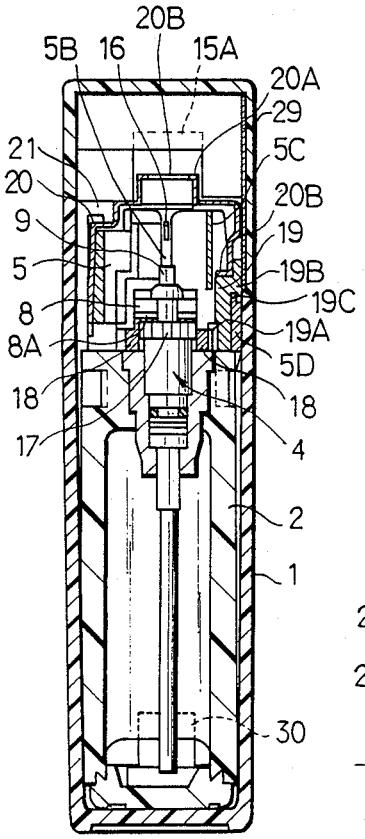
FIG. 3 is another longitudinal section of the tabletop gaslighter.

Referring to the drawings, a tabletop gaslighter according to a preferred embodiment of the present invention comprises a plastic casing 1 which has an inclined opening 1A. A plastic gas cell 2 is pushed into the casing 1, and then the gas cell 2 is fixedly sandwiched and held between longitudinal ribs 3 on the inner opposite walls of the casing 1. As shown, the gas cell 2 has a flame valve 4 fixed on one side and a longitudinal hole 11 on the other side of the casing 1. The gas cell 2 is filled with a liquefied gas.

A bracket 5 made of insulating material such as a plastic et al is put on the top of the gas cell 2 with the nails 5A of the bracket 5 inserted into a hole 6 of the gas cell 2 to be caught by catch slots 7 of the gas cell 2 with a click.

An operating lever 8 of an electrically conductive plastic material is pivoted at its center by pins 10 in the bracket 5. Its top biforked fingers 8A pinch the neck of the nozzle 9 which is associated with the flame valve 4. The operating lever 8 can move somewhat up and down at its pivot 10. As shown, the rear part of the lever which projects from the bracket 5, has a slant surface 8B. The peizoelectric unit 12 is pushed in the longitudinal hole 11 of the gas cell 2, exposing the upper half length of the piezoelectric unit 12. It comprises telescopic outer and inner cases 12A and 12B. These cases contain a piezoelectric device, a hammer, a spring etc., although not shown. The outer case 12A has a lever push-and-terminal electrode 13 at the midpoint of one side of the outer case 12A for depressing the slant surface 8B of the lever 8 on the compression of the piezoelectric unit 12.

Also, the outer case 12A has another terminal electrode 14 of the piezoelectric unit 12 on the upper part of the opposite side of the outer case 12A. An electric discharge extension 16 is fixed to the top of the piezoelectric unit 12 with its rear end in contact with the terminal electrode 14 of the piezoelectric unit 12 and its forward end facing the nozzle 9 of the flame valve 4. A thumb-push cap 15 of a plastic material is put on the electric discharge extension 16. As shown, the bracket 5 has a vertical slot 5B, thereby allowing the electric discharge extension 16 to descend at the time of compression of the piezoelectric unit 12.

The flame valve 4 has a gas flow adjusting screw 17. A flame adjusting ring 18 is fitted on the gas flow adjusting screw 17. A flame adjusting lever 19 has a rack 19A for engaging the flame adjusting ring 18. The flame adjusting lever 19 is slidably fixed to parallel guide pieces 5C and 5D of the bracket 5. A flame adjusting tip 19B of the flame adjusting lever 19 appears on one side of the bracket 5. The flame adjusting lever 19 has a guide slot 19C behind the lower edge of the flame adjusting tip 19B, and the bracket 5 has a raised guide piece 5D. This is fitted in the guide slot 19c of the flame adjusting lever 19. A windshield 20 is combined with the bracket 5, exposing the flame adjusting tip 19B so as to permit access by fingers.

As shown, the windshield 20 is clicked to the bracket 5 with its hollow cylinder 20A just above the nozzle 9 of the flame valve 4, thereby permitting a small flame to shoot upward through the flame opening 20B of the hollow cylinder 20A.

A top closure 21 has a window cut 21B and a hole 21A on its top and side, and two legs 21C extending down from its opposite sides. Its inside is lined with metal to prevent melting and deformation by heat. The opposite legs 21C of the top closure 21 are pushed in the casing 1 until they have been caught by projections 1B on the inside wall of the casing 1, exposing the flame adjusting tip 19B and the top 15A of the operating cap 15 from the window cut 21B and the hole 21A, respectively. Thus, access to the flame adjusting tip 19B and the operating cap 15 by fingers are permitted, and the gas cell 2, the operating cap 15 and the windshield 20 are prevented from slipping off from the casing 1.

Figure 4:
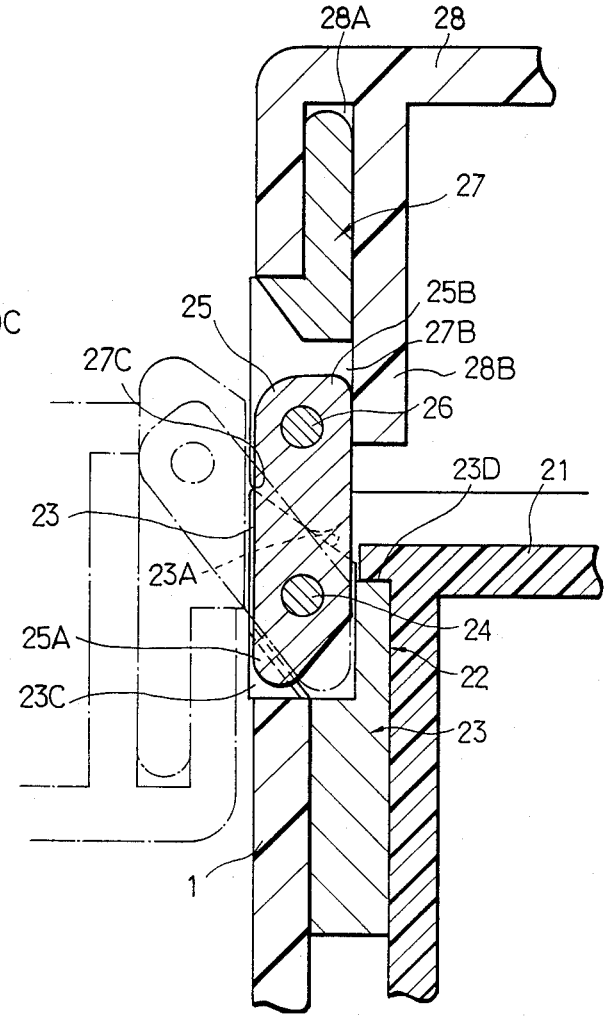
FIG. 4 is an enlarged section of the link-hinge of the closure.
Figure 5:
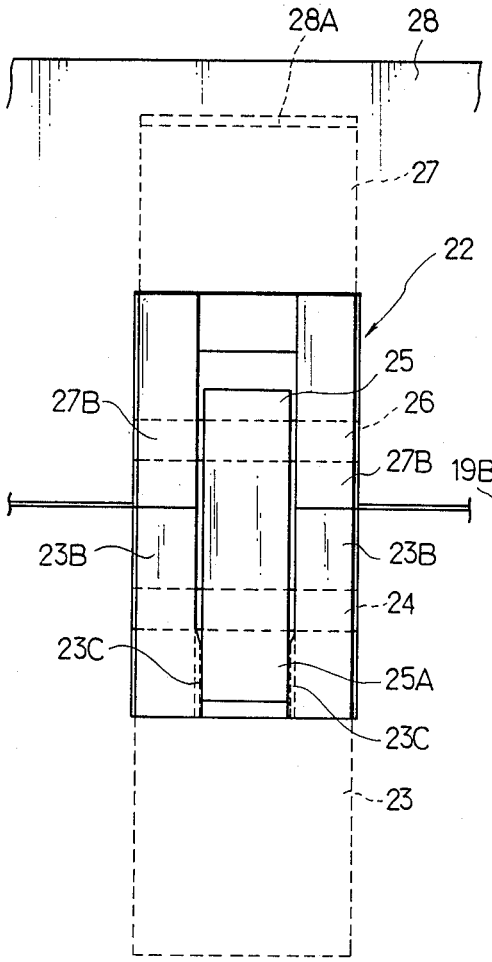
FIG. 5 is a rear view of the link-hinge of the closure.
Figure 6:
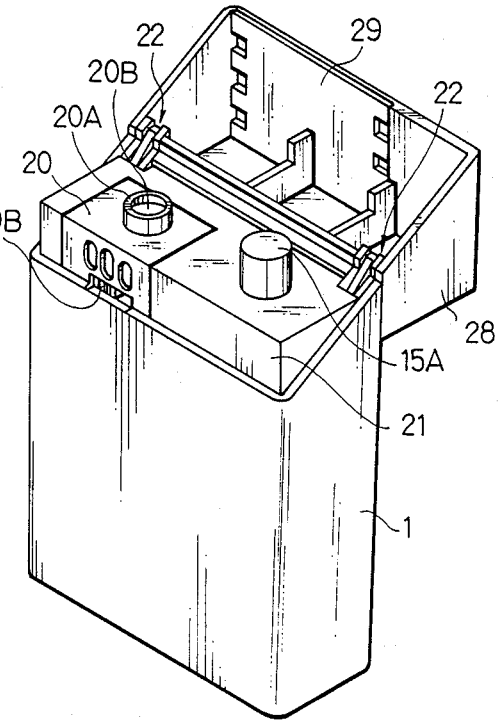
FIG. 6 is a perspective view of the gaslighter with its top closure open.
Figure 7:
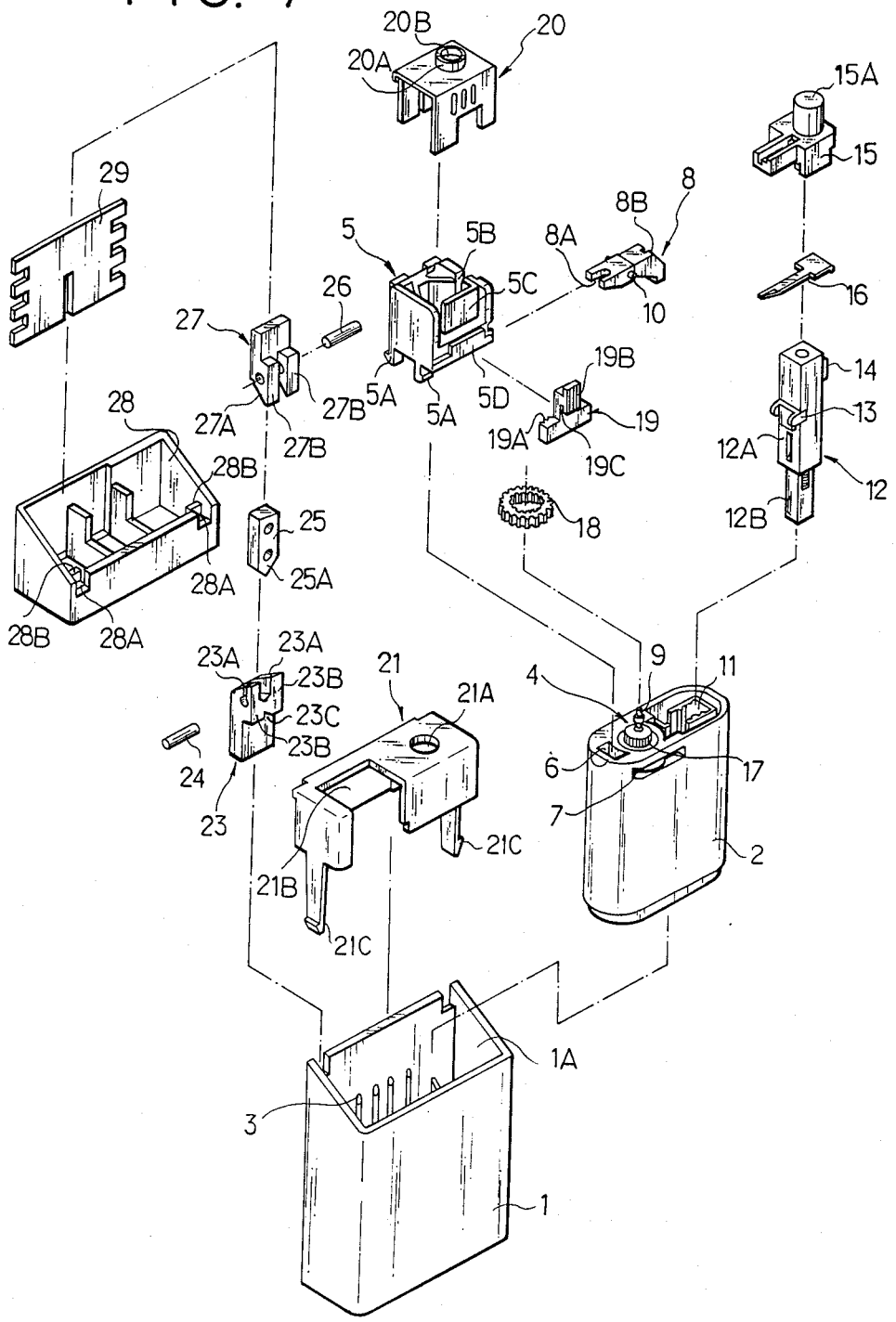
FIG. 7 is an exploded view of the gaslighter.

A link type hinge 22 is sandwiched between the inside surface of the casing 1 and the outside surface of the top closure 21, as best seen in FIG. 4. It is composed of a casing hold piece 23, a closure hold piece 27 and a connecting rod 25 rotatably connected to the casing and closure hold pieces 23 and 27 at its opposite ends with pins 24 and 26. As best shown in FIG. 7, each hold piece has a biforked rise 23B or 27B, and the opposite ends of the connecting rod 25 are inserted in the biforked rises 23B and 27B, and are rotatably fixed with pins 24 and 26.

Inner projections 23C are integrally connected to the inner sides of the biforked rises 23B and 27B to define such a space that the end 25A of the connecting rod 25 when pushed into the reduced interspace, may be firmly held, thereby keeping the link assembly 25 straight upward.

As shown, the casing hold piece 23 has an inclined surface 23A at its top end, and likewise the closure hold piece 27 has an inclined surface 27A at its bottom end, which is complementary to the inclined surface 23A of the casing hold piece 23 in shape and size. Thus, as best shown in FIG. 4, the link assembly can be extended straight with the inclined contact surfaces 23A and 27A of the opposite hold pieces 23 and 27 abutting on each other. In opening and closing the closure 28 it is rotated around the link type hinges. Then, one can have a pleasing feeling when the inclined surface 27A of the closure hold piece 27 turns smartly about its pivotal edge 27C to fall or stand with a click, thereby opening or closing the closure 28. As best shown in FIG. 4, the casing hold piece 23 is held firmly between the casing 1 and the top closure 21, and the shoulder 23D of the casing hold piece 23 is caught by the edge of the top closure 21, thus preventing the casing hold piece 23 from slipping off from the casing 1.

As clearly shown in FIG. 4, the closure 28 is fixed to the closure hold piece 27. Specifically, the closure 28 has opening 28A. The closure hold piece 27 is inserted into the opening 28A. The closure 28 has a slant opening complementary to the slant opening of the casing 1. It has two resilient projections 28B in contact with the closure hold piece 27 so that the rounded edge 25B of the connecting rod 25 may slip smoothly on the surfaces of the resilient projections 28B in opening and closing the closure 28. The close contact of the resilient projections 28B against the top side of the connecting rod 25 under the resilient influence assures that the closure 28 is held at an exact angle in its closing position. The closure 28 has a metal plate 29 applied to a selected closure inside area in the vicinity of the flame hole 20B, thereby preventing any thermal deformation of the closure 28. In the drawings a gas injection valve is indicated at 30.

As understood from the above, a tabletop gaslighter can be assembled by piling necessary parts one after another in a predetermined order and locking them with each other without recourse to screws, thus permitting a full automatization in assembling necessary parts into tabletop gaslighters, and hence reduction in production cost to a minimum is possible.

While the invention has been particularly shown and described in reference to preferred embodiments thereof, it will be understood by those skilled in the art that changes in form and details may be made therein without departing from the spirit and scope of the invention.

What is claimed is:

1. A tabletop gaslighter comprising: a casing which is closed at its bottom and open at its top; a gas cell to be fitted in the casing, the gas cell having a flame valve fixed to one side of the gas cell and a longitudinal hole made at the other side of the gas cell; a hollow bracket to be clicked to the top of the gas cell with associated catch, allowing the flame valve to pass through the bracket and supporting a flame adjusting ring and a valve opening lever; a piezoelectric unit to be inserted in the longitudinal hole of the gas cell, the piezoelectric unit having a thumb-operated cap put on its top; and a top closure to be fixed to the casing with associated catch to prevent the thumb-operated cap, bracket and gas cell from slipping off, whereby the depression of the thumb-operated cap causes the simultaneous operation of the piezoelectric unit and the valve operating lever to strike spark across the ejection of gas and cause a small flame to shoot upward.

* * * * *